US008347984B2

(12) United States Patent
Light

(10) Patent No.: US 8,347,984 B2
(45) Date of Patent: Jan. 8, 2013

(54) VARIABLE FORCE/VARIABLE FREQUENCY SONIC DRILL HEAD

(75) Inventor: Trevor Lyndon Light, Sandy, UT (US)

(73) Assignee: Longyear™, Inc., South Jordan, UT (US)

( * ) Notice: Subject to any disclaimer, the term of this patent is extended or adjusted under 35 U.S.C. 154(b) by 233 days.

(21) Appl. No.: 12/768,390

(22) Filed: Apr. 27, 2010

(65) Prior Publication Data

US 2010/0276198 A1 Nov. 4, 2010

Related U.S. Application Data

(60) Provisional application No. 61/173,905, filed on Apr. 29, 2009.

(51) Int. Cl.
*E21B 7/24* (2006.01)

(52) U.S. Cl. ..... 175/55; 175/57; 74/61

(58) Field of Classification Search ..... 175/55, 175/57; 74/61, 87; 173/49; 209/367
See application file for complete search history.

(56) References Cited

U.S. PATENT DOCUMENTS 2,410,170 A * 10/1946 Lazan ..... 74/61
2,831,353 A * 4/1958 Ongaro ..... 74/61
3,583,497 A * 6/1971 Kussowski et al. ..... 173/49
4,113,034 A 9/1978 Carlson
4,350,460 A * 9/1982 Schmelzer et al. ..... 404/117
4,481,835 A * 11/1984 Storm ..... 74/61
4,978,488 A * 12/1990 Wallace ..... 264/72
5,004,055 A 4/1991 Porritt et al.
5,058,688 A * 10/1991 Scott et al. ..... 175/20
6,129,159 A 10/2000 Scott et al.
6,604,583 B1 8/2003 Van Randen
7,171,866 B2 * 2/2007 Fervers et al. ..... 74/87
2003/0029310 A1 * 2/2003 Glasson ..... 92/5 R
2004/0003671 A1 * 1/2004 Fervers et al. ..... 74/87
2008/0219085 A1 * 9/2008 Heichel et al. ..... 366/128
2010/0147090 A1 * 6/2010 Kuerten ..... 74/61

OTHER PUBLICATIONS

Written Opinion of the ISA dated Nov. 1, 2011 from International Application No. PCT/US2010/032738 filed Apr. 28, 2010 (5 pages).
International Search Report dated Dec. 29, 2010 from International Application No. PCT/US2010/032738 filed Apr. 28, 2010 (3 pages).

* cited by examiner

*Primary Examiner* — William P Neuder
*Assistant Examiner* — Blake Michener
(74) *Attorney, Agent, or Firm* — Ballard Spahr LLP

(57) ABSTRACT

An oscillator assembly includes a first eccentrically weighted rotor having a first eccentric weight configured to rotate about an axis, a second eccentrically weighted rotor having a second eccentric weight configured to rotate about the axis. Rotation of the first eccentrically weighted rotor is coupled to rotation of the second eccentrically weighted rotor. An actuator is configured to vary an angular separation between the first eccentric weight and the second eccentric weight.

22 Claims, 8 Drawing Sheets

VARIABLE FORCE/VARIABLE FREQUENCY SONIC DRILL HEAD

CROSS-REFERENCE TO RELATED APPLICATIONS

The present application claims the benefit of U.S. Provisional Application No. 61/173,905 filed Apr. 29, 2009 and entitled "Variable Force/Variable Frequency Sonic Drill Head", the disclosure of which is hereby incorporated by reference in its entirety.

BACKGROUND OF THE INVENTION

1. The Field of the Invention

The present invention relates to drill heads and to drill heads configured to generate oscillating vibratory forces.

2. The Relevant Technology

Sonic head assemblies are often used to vibrate a drill string and the attached coring barrel and drill bit at high frequency to allow the drill bit and core barrel to penetrate through the formation as the drill bit rotates. Accordingly, some drilling systems include a drill head assembly that includes both an oscillator to provide the high frequency input and a motor driven gearbox to rotate the drill string. The sonic head includes pairs of eccentrically weighted rotors that are rotated to generate oscillating or vibratory forces. The eccentrically weighted rotors are coupled to a spindle. The spindle can in turn be coupled to a drill rod such that turning the eccentrically weighted rotors transmit a vibratory force from the spindle to the drill rod.

The force generated by the sonic head depends, at least in part, on the eccentric weight of the rotors, the eccentric radius of the eccentric weight of the rotors, and the rotational speed of the eccentric rotors. In most systems, the eccentric weight and eccentric radius of the rotors are fixed. Accordingly, in order to vary the vibratory forces generated by a given sonic head, the rotational speed of the eccentric rotors is varied. Each system has a natural harmonic frequency at which the vibratory forces resonate through the system resulting in extremely large forces. As the sonic head spins the rotors up to the desired rotational speed to apply a selected vibratory force, the system often passes through one or more of the harmonic frequencies. The forces generated at these harmonic frequencies are often large enough to damage the sonic head and other parts of the drilling system. The maximum force output of the oscillator can thus be dictated by the speed of rotation, which can be held below a speed corresponding to a harmonic frequency.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF THE INVENTION

An oscillator assembly includes a first eccentrically weighted rotor having a first eccentric weight configured to rotate about an axis, a second eccentrically weighted rotor having a second eccentric weight configured to rotate about the axis. Rotation of the first eccentrically weighted rotor is coupled to rotation of the second eccentrically weighted rotor. An actuator is configured to vary an angular separation between the first eccentric weight and the second eccentric weight.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

BRIEF DESCRIPTION OF THE DRAWINGS

To further clarify the above and other advantages and features of the present invention, a more particular description of the invention will be rendered by reference to specific examples which are illustrated in the appended drawings. It is appreciated that these drawings depict only typical examples of the invention and are therefore not to be considered limiting of its scope. Examples will be described and explained with additional specificity and detail through the use of the accompanying drawings in which.

Figure 1A:
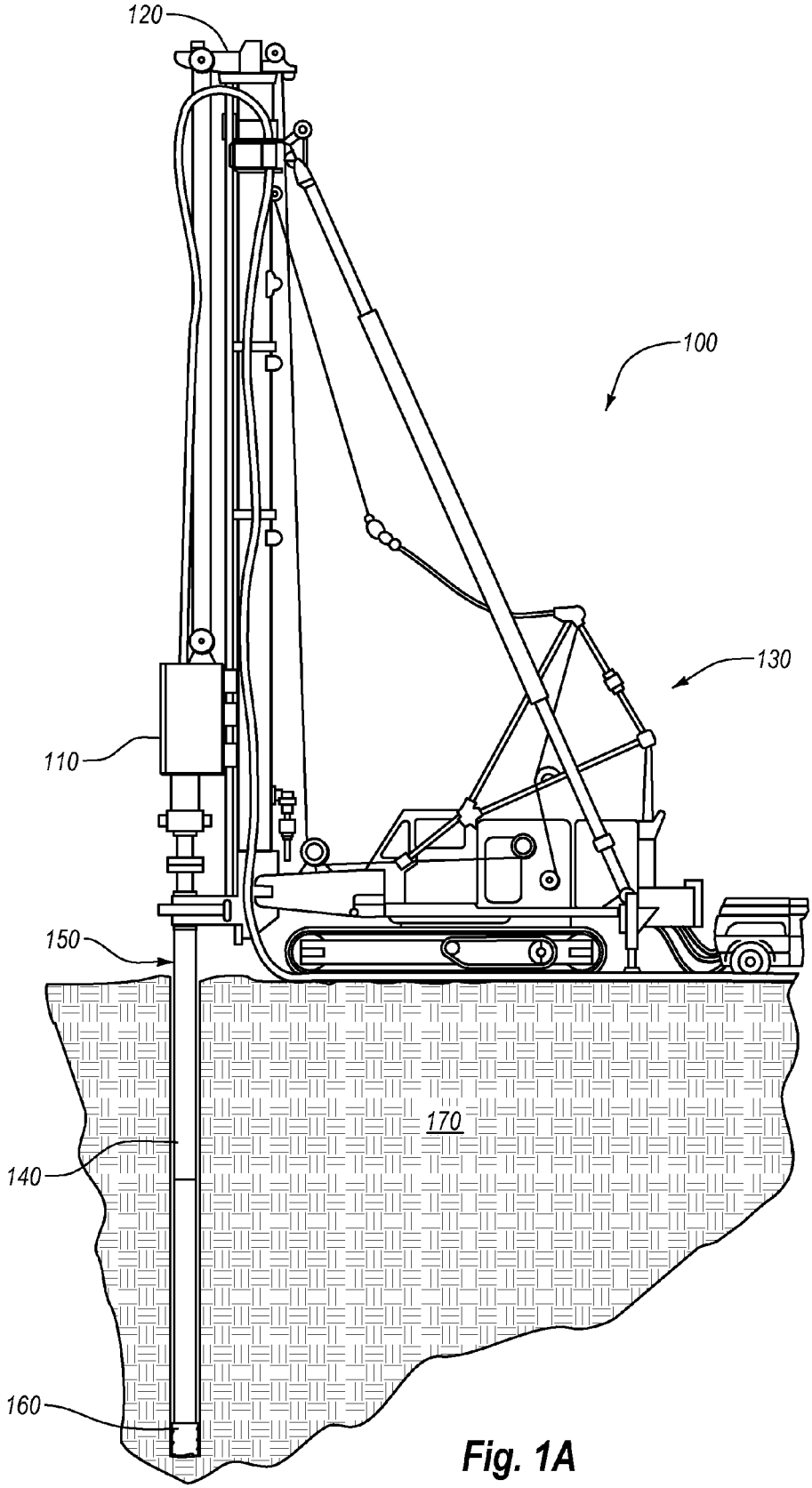
FIG. 1A illustrates a drilling system according to one example.

Together with the following description, the figures demonstrate non-limiting features of exemplary devices and methods. The thickness and configuration of components can be exaggerated in the figures for clarity. The same reference numerals in different drawings represent similar, though not necessarily identical, elements.

DETAILED DESCRIPTION OF THE PREFERRED EMBODIMENTS

Devices, systems, and methods are provided herein for sonic drilling that include at least one variable force/variable frequency oscillator assembly. In at least one example, such an oscillator assembly includes a first eccentrically weighted rotor with a first eccentric weight, a second eccentrically weighted rotor with a second eccentric weight, a coupling shaft, an actuator, and a motor. The motor can be configured to rotate the coupling shaft. The coupling shaft includes a straight splined portion associated with the first eccentrically weighted rotor and a helical portion associated with the second eccentrically weighted rotor.

The actuator can move the coupling shaft, such as through axial translation, to cause relative angular movement between the first and second rotors through a range of 180 degrees. Varying the angular separation between the two rotors can vary the centrifugal forces generated by rotation of the oscillator assembly at a given rotational speed or frequency. Accordingly, force can be varied independently of frequency, which can allow a drilling system to apply varying forces at a given frequency and given forces at varying frequencies while avoiding undesirable frequencies, such as natural or harmonic frequencies.

FIG. 1A illustrates a drilling system 100 that includes a drill head assembly 110. The drill head assembly 110 can be coupled to a mast 120 that in turn is coupled to a drill rig 130. The drill head assembly 110 is configured to have a drill rod 140 coupled thereto. The drill rod 140 can in turn couple with additional drill rods to form a drill string 150. In turn, the drill string 150 can be coupled to a drill bit 160 configured to interface with the material to be drilled, such as a formation 170.

In at least one example, the drill head assembly 110 is configured to rotate the drill string 150 at varying rates as desired during the drilling process. Further, the drill head assembly 110 can be configured to translate relative to the mast 120 to apply an axial force to the drill head assembly 110 to urge the drill bit 160 into the formation 170. The drill head assembly 110 can also generate oscillating forces that are transmitted to the drill rod 140. These forces are then transmitted from the drill rod 140 through the drill string 150 to the drill bit 160.

Figure 1B:
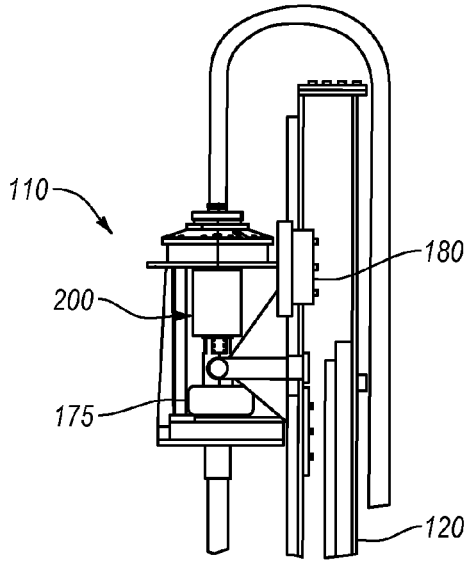
FIG. 1B illustrates a drilling head that includes a sonic drill head and a rotary head assembly according to one example.

FIG. 1B illustrates the drill head assembly 110 in more detail. As illustrated in FIG. 1B, the drill head assembly 110 can include a rotary portion 175 mounted to a sled 180. The drill head assembly 110 can further include a sonic drill head 200 mounted to the sled 180.

Figure 2A:
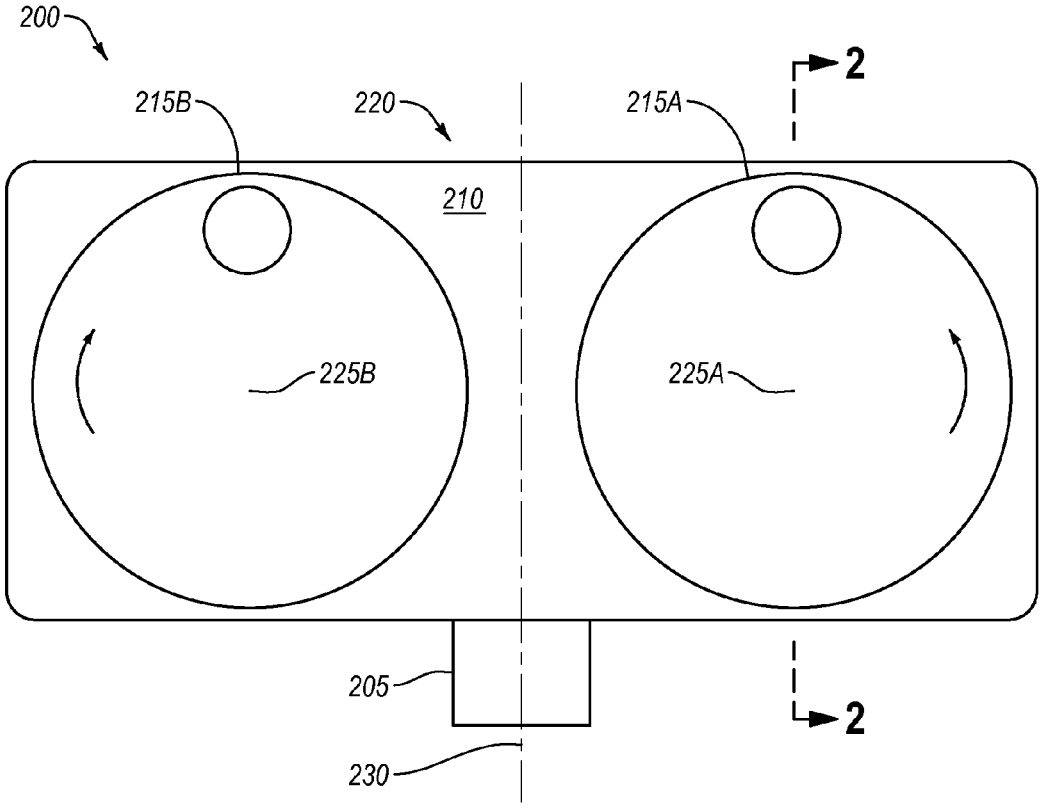
FIG. 2A illustrates an assembled view of the example sonic drill head.

FIG. 2A illustrates an isolated elevation view of the sonic drill head 200 in more detail. The sonic drill head 200 includes an oscillator 210 having first and second opposing oscillator assemblies 215A, 215B positioned within a housing 220. The oscillator assemblies 215A, 215B are configured to rotate about axes 225A, 225B to generate cyclical, oscillating centrifugal forces. Centrifugal forces due to rotation of the oscillator assemblies 215A, 215B can be resolved into a first component acting parallel to a drive shaft axis 230 and a second component acting transverse to the drive shaft axis 230. In at least one example, a force acting parallel to the drive shaft axis 230 can be described as acting in the transmission direction.

In at least one example, the oscillator assemblies 215A, 215B rotate at identical speeds but opposite directions. Further, the oscillator assemblies 215A, 215B can be oriented such that as they rotate, the second component of the centrifugal forces acting transverse to the drive shaft axis 230 cancel each other out while the first components acting parallel to the drive shaft axis 230 combine, resulting in axial, vibratory forces.

These oscillating vibratory forces are transmitted to the housing 220. A drive shaft 205 may be coupled to the oscillator housing 220 in such a manner that the centrifugal forces described above can be transmitted from the oscillator housing 220 to the drive shaft 205. The drive shaft 205 then transmits the forces to other components, such as a drill rod.

Figure 2B:
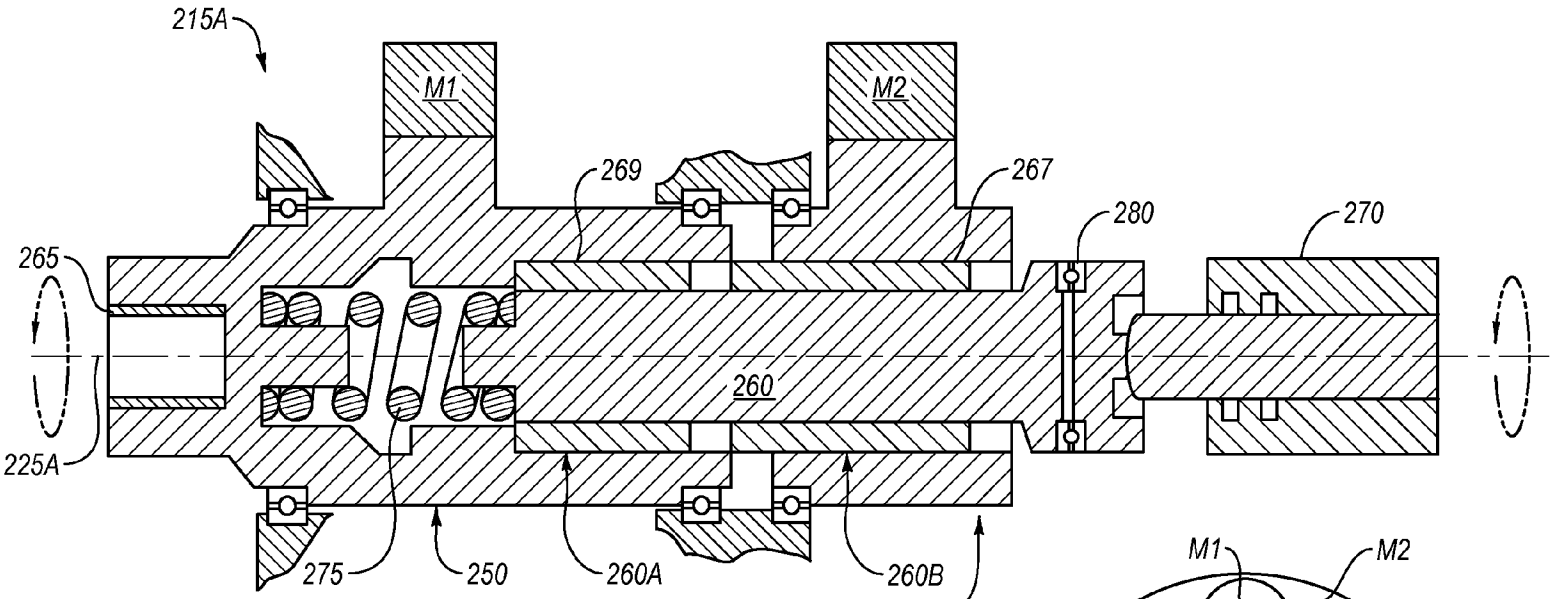
FIG. 2B-2C illustrate cross sectional views of an example oscillator assembly of the exemplary sonic drill head of FIG. 2A taken along section 2-2.

As shown in FIG. 2B, first oscillator assembly 215A includes a plurality of eccentrically weighted rotors 250, 255 each having eccentric weights M1, M2 that rotate about a common axis 225A. The second eccentrically weighted rotor 215B has a similar configuration such that the description of the first eccentrically weighted rotor 215A may be equally applicable to the second eccentrically weighted rotor 215B.

An angular separation of the eccentric weights M1, M2 relative to each other can be varied as desired. Varying the angular separation of the eccentric weights M1, M2 within the first oscillator assembly 215A can allow the sonic drill head 200 (FIG. 2A) to vary the force generated by the first oscillator assembly 215A as it rotates at a given velocity. In particular, an angular separation of 180 degrees between the eccentric weights M1, M2 causes the force generated by rotation of one eccentrically weighted rotor 250 to balance out the force generated by the rotation of the other eccentrically weighted rotor 255. Similarly, angular alignment of the eccentrically weighted rotors 250, 255 can result in a summation of the forces generated by eccentrically weighted rotors 250, 255. Adjusting the angular separation between the eccentric weights M1, M2 can therefore vary the resulting force generated by the rotation of eccentrically weighted rotors 250, 255. In at least one example, the eccentrically weighted rotors 250, 255 may be rotated by a single rotational output while in other examples the eccentrically weighted rotors 250, 255 may be rotated by distinct, separate rotary outputs. For ease of reference, a single rotational output will be described below.

FIGS. 2B-2C and FIGS. 2E-2F illustrate a cross-sectional view of the oscillator assembly 215A taken along section 2-2 of FIG. 2A. While oscillator assembly 215A is shown, it will be appreciated that the discussion of the oscillator assembly 215A can be applicable to the other oscillator assembly 215B rotating in the opposite direction. Further, while two opposing oscillator assemblies 215A, 215B are shown in FIG. 2A, it will be appreciated that any number of eccentrically weighted rotors can be positioned within each oscillator assembly and that any number of oscillator assemblies can be combined as desired. The configuration of the example first oscillator assembly 215A will now be described in more detail.

FIG. 2B, illustrates a cross-sectional view of the first oscillator assembly 215A according to one example. Locations and sizes of various components may have been exaggerated for ease of illustration. As shown in FIG. 2B, a coupling shaft 260 couples the first eccentrically weighted rotor 250 and the second eccentrically weighted rotor 255 that rotate about the common axis 225A. In the example illustrated in FIGS. 2B-2D, the coupling shaft 260 includes a straight splined portion 260A configured to receive a rotational input from the first eccentrically weighted rotor 250 and to transmit the rotational input to the second eccentrically weighted rotor 255 by a helically splined portion 260B. Translation of the coupling shaft 260 parallel to the axis 225A varies the angular separation between the eccentric weights M1, M2, as will be discussed in more detail below.

A drive motor 265 can be coupled to the first eccentrically weighted rotor 250 to provide rotation. The coupling shaft 260 is coupled to the first eccentrically weighted rotor 250 in such a manner as to allow the coupling shaft 260 to translate relative to the first eccentrically weighted rotor 250 along the axis 225A. Further, the coupling shaft 260 may be configured to remain engaged with the first eccentrically weighted rotor 250 in such a manner as to allow the coupling shaft 260 to drive the first eccentrically weighted rotor 250. Accordingly, the straight-splined portion 260A may include straight splines 269 that engage similarly shaped recesses defined in the first eccentrically weighted rotor 250. Such a configuration allows the coupling shaft 260 to translate relative to the first eccentrically weighted rotor while receiving a rotational input from the first eccentrically rotor 250.

As introduced, the coupling shaft 260 is configured to transmit the rotation input to the second eccentrically weighted rotor 255. In at least one example, the coupling shaft 260 can be configured to engage various portions of the second eccentrically weighted rotor 255. In particular, the helical portion 260B (FIG. 2B) includes individual splines 267 that are helically wound about the coupling shaft 265. At each axial position of the helical portion 260B the helical splines 267 are positioned at varying angular positions. For ease of reference, these angular positions can be described as varying relative to the straight splines 269 parallel to the axis 225A. As a result, as the helical splines 267 move further away from the straight splined portion 260A, the angular separation between the helical splines 267 and the corresponding straight splines 269 also increases.

Figure 2C:
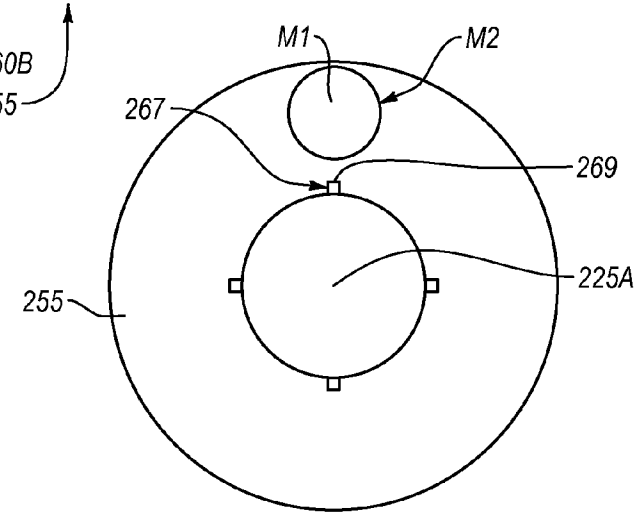
Figure 2D:
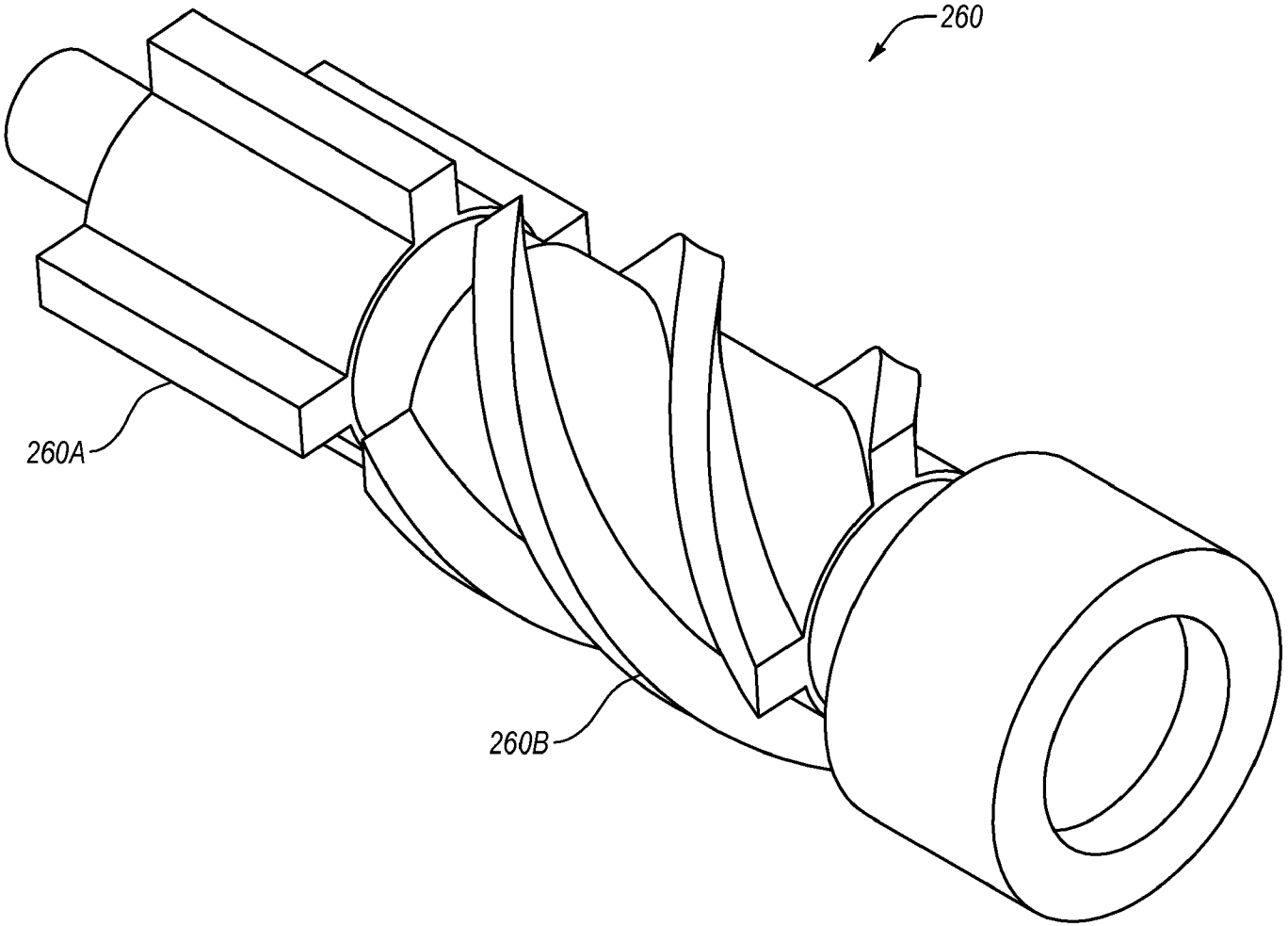
FIG. 2D illustrates a perspective view of a coupling shaft according to one example.

FIG. 2C illustrates the engagement between the helical portion 260B and the second eccentric weight M2 in which other components have been removed for clarity. In particular, FIG. 2C illustrates the helical splines 267 engaged with the second eccentric weight M2 at an axial position on the helical portion 260B in which the second eccentric weight M2 is aligned relative to the first eccentric weight M1. At this axial position the helical splines 267 are also at a first angular position relative to corresponding straight splines 269. For ease of reference, the helical splines 267 at the axial position shown in FIG. 2C will be described as being aligned relative to the straight splines 269.

Accordingly, the helical splines 267 are shown aligned relative to straight splines 269, such that straight splines 269 are hidden by the helical splines 267 in contact with the second eccentrically weighted rotor 255 and in which the first eccentric weight M1 is also aligned and therefore covered by the second eccentric weight M2.

As shown in FIG. 2B the coupling shaft 260 can translate along the axis 225A to vary the angular position of the helical splines 267 relative to the straight splines 269 and thus the angular position of the first eccentric weight M1 relative to the second eccentric weight M2. For example, the biasing member 275 exerts a force to move the helical portion 260B away from the first eccentrically weighted rotor 250. The actuator 270 acts in opposition to the biasing member 275 such that extension of the actuator 270 overcomes the force of the biasing member 275 to move the helical portion 260B toward the first eccentrically weighted rotor 250.

Accordingly, retracting the actuator 270 allows a force exerted by the biasing member 275 to move the helical portion 260B away from the first eccentrically weighted rotor 250. The actuator 270 and the biasing member 275 maintain the second eccentrically weighted rotor 255 at the selected axial position relative to the axis 225A as the coupling shaft 260 rotates. Accordingly, the actuator 270 and the biasing member 275 can cooperate to vary which part of the helical portion 260B engages the second eccentrically weighted rotor 255.

Figure 2E:
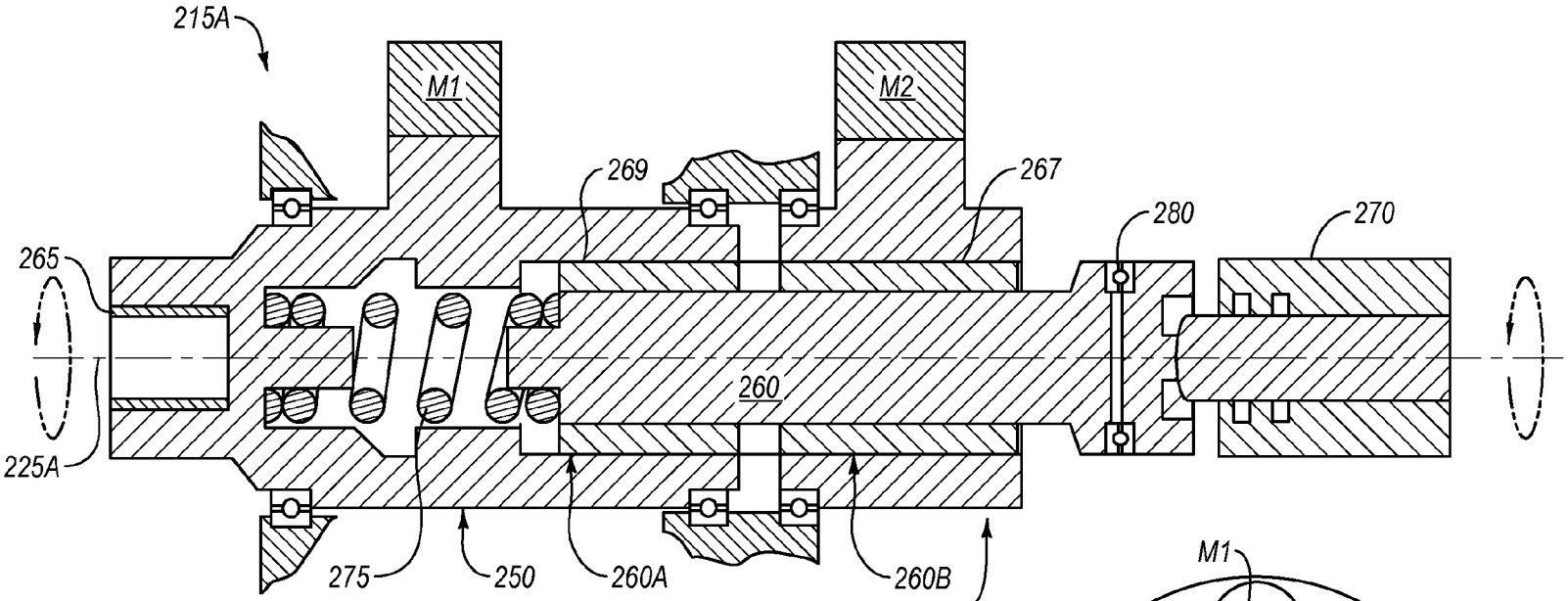
FIGS. 2E-2F illustrate cross-sectional view of the oscillator assembly of FIGS. 2B-2C.
Figure 2F:
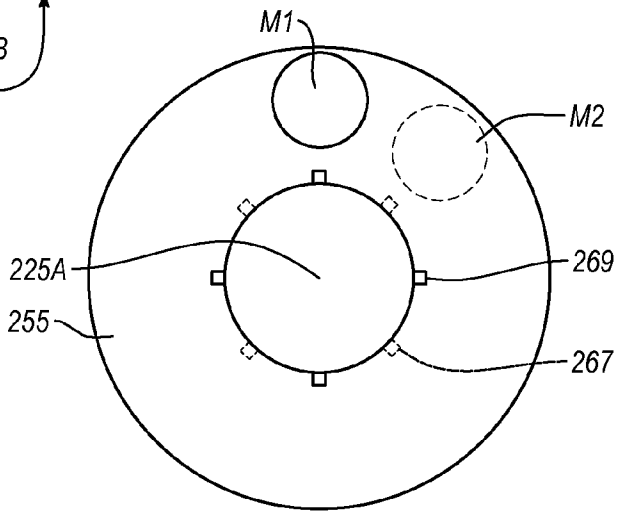

FIG. 2E illustrates the actuator 270 and the biasing member 275 cooperating to move the helical portion 260B away from the first eccentrically weighted rotor 250. As the helical portion 260B advances to the position shown in FIG. 2E, the portion of the helical splines 267 in contact with the second eccentrically weighted rotor 255 is at an angular separation relative to the corresponding straight splines 269. The angular separation between the straight splines 269 and the engaged portion of the helical splines 267 shown results in the angular separation between the first eccentric weight M1 and the second eccentric weight M2 illustrated in FIG. 2F.

Further movement of the helical portion 260B away from the first eccentrically weighted rotor 250 can further increase the angular separation while moving the helical portion 260B toward the first eccentrically weighted rotor 250 can decrease the angular separation. Accordingly, the angular separation between the first eccentric weight M1 and the second eccentric weight M2 can be varied by controlling which axial portion of the helical portion 260B engages the second eccentrically weight rotor. In at least one example, angular separation between the first eccentric weight M1 and the second eccentric weight M2 can vary between 0 or an aligned position to 180 degrees.

In the illustrated example, reference has been made to movement of the coupling shaft 260 relative to the first eccentrically weighted rotor to vary angular separation. Similarly, various angles and orientations have been described. It will be appreciated that any reference point can be selected in describing a system that includes a coupling shaft that translates axially relative to two eccentrically weighted rotors to control the angular separation between eccentric weights associated with the eccentrically weighted rotors. Further, any rate of twist, combination of twists, or other engagement profiles can be provided on the coupling shaft to allow the coupling shaft to vary angular separation between eccentric weights by varying which portion of the shaft is in contact with one or more of the eccentrically weighted rotors.

In at least one example, the actuator 270 can include a hydraulic cylinder and can also include an integrated LVDT type transducer or other line actuator aligned, coupled, or in contact with the coupling shaft 260. Further, a bearing, such as a thrust bearing 280, can be positioned between the coupling shaft 260 and the actuator 270 to isolate the actuator 270 from the rotation of the coupling shaft 260 while still allowing the actuator 270 to move the coupling shaft 260 about the axis 225A.

As will be described in more detail with reference to FIGS. 3A and 3D, the angular separation between the first eccentric weight M1 and the second eccentric weight M2 can be changed to vary the force generated by rotation of the oscillator assembly 215A as a whole. As previously introduced, the first and second eccentrically weighted rotors 250, 255 both rotate about the common axis 225A. Accordingly, the angular position of the first eccentric weight M1 and the second eccentric weight M2 can both be described with reference to the common axis, which appears as a single point in FIGS. 3A-3D. The axial position of the helical portion 260B (FIG. 2D) along the axis 225A relative to the second eccentrically weighted rotor 255 (which is into and out of the page in FIGS. 3A-3D) determines the angular separation between the first and second eccentric weighs M1 and M2 as described above.

As shown in FIGS. 3A-3D, the second eccentrically weighted-rotor assembly 215B includes eccentric weights M3 and M4. The first rotor assembly 215A rotates about the axis 225A while the second rotor assembly 215B rotates about the axis 225B. Oscillation forces generated by rotation of the first and second eccentrically weighted-rotor assemblies 215A, 215B, represented collectively as arrows 300, act parallel to a drive shaft axis 230 associated with the drive shaft 205 while transverse forces act perpendicular to the drive shaft axis 230. In the illustrated example, the drive shaft axis 230 is positioned between the axes 225A, 225B. It will be appreciated that in other examples, the axes 225A, 225B can be positioned at any desired position and/or orientation relative to the drive shaft axis 230.

As described above, various angular separations can be established to vary the oscillation force generated by a sonic head. In particular, FIG. 3A illustrates first and second eccentrically weighted-rotor assemblies 215A, 215B rotating in opposite directions in which eccentric weights M1 and M2 are separated by an angular separation 310 of approximately 180 degrees. Similarly, eccentric weights M3 and M4 are separated by a second angular separation 320 of approximately 180.

Rotation of the first and second weighted rotor assemblies 215A, 215B results in a centrifugal forces F1-F4 acting due to the rotation of the eccentric weights M1-M4. Each of the forces F1-F4 can be resolved into an oscillation force acting parallel to the drive shaft axis 230, labeled as $F1_y$-$F4_y$ respectively, and transverse forces acting perpendicular to the drive shaft axis 230, labeled as $F1_x$-$F4_x$. In at least one example, the rotation of eccentric weight M1 can be coordinated with M2 such that transverse forces $F1_x$ and $F2_x$ cancel out transverse forces $F3_x$ and $F4_x$ while the oscillation forces $F1_y$-$F4_y$ act in concert. As will be described in more detail below, the angular separations 310, 320 can be selected to vary the oscillation forces between a minimum, which may be near zero, and a maximum. Exemplary positions will be described in more detail below.

Figure 3A:
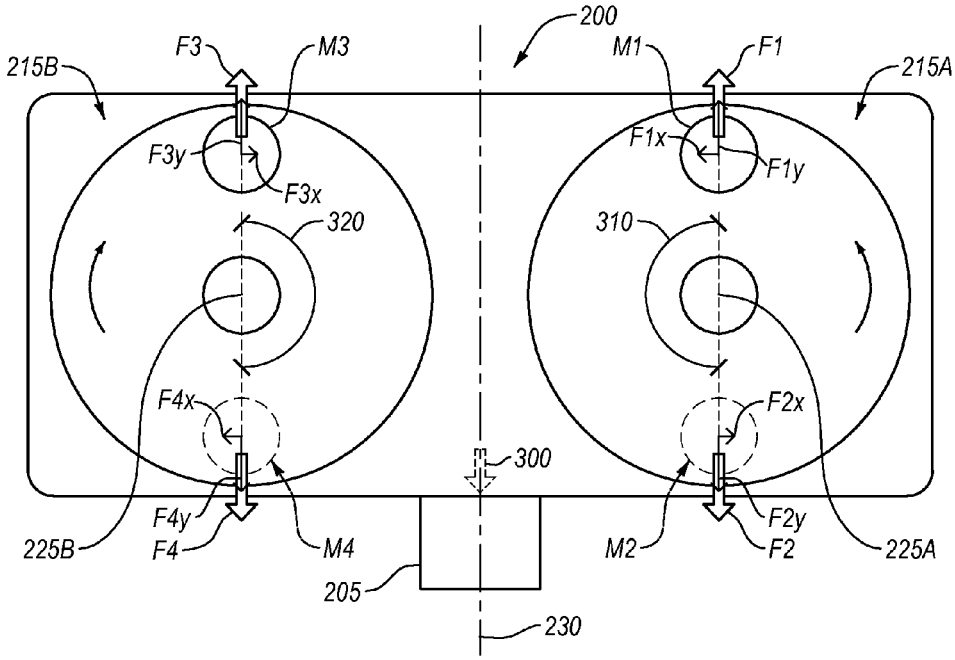
FIGS. 3A-3D illustrate a sonic drill head with eccentric weights in eccentrically weighted rotors at various angular separations.

In the example illustrated in FIG. 3A, centrifugal forces F1-F4 generated by rotation of the eccentric weights M1-M4 are cancelled by an opposing eccentric weight, resulting in no force transmission. In particular, in all instances F1 cancels $F3_x$ while $F2_x$ cancels $F4_x$. With the angular separations 310, 320 shown established, $F1_y$ is equal in magnitude to $F2_y$, but $F1_y$ acts in the opposite direction than $F2_y$. Similarly, $F3_y$ cancels $F4_y$. Accordingly, in the example shown in FIG. 3A no forces are transmitted to the shaft 205.

Figure 3B:
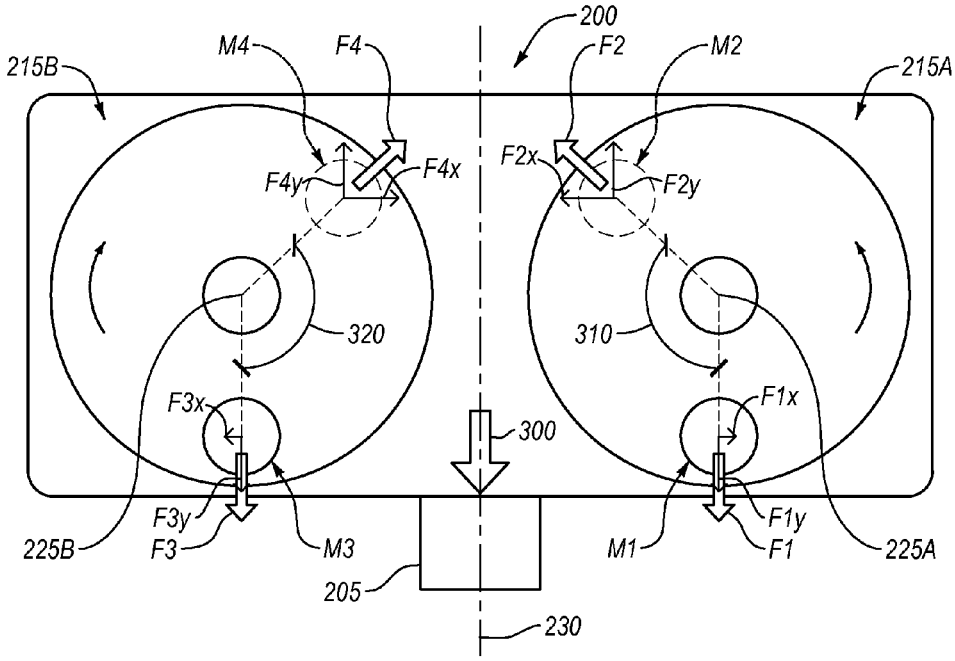

FIG. 3B illustrates an example in which the angular separation 310 between the first eccentric weight M1 and the second eccentric weight M2 has been selected to be less than 180 degrees but greater than 90 degrees. As a result, within the first eccentrically weighted rotor assembly 215A part of the centrifugal force F1 generated by rotation of the first eccentric weight M1 is offset by the centrifugal force F2 generated by rotation of the second eccentric weight M2.

More specifically, a portion of $F1_y$ is countered by $F2_y$. As shown in FIG. 3B, the second angular separation 320 between third eccentric weight M3 and the fourth eccentric weight M4 can be the same as the first angular separation 310. As a result, a portion of $F3_y$ is countered by $F4_y$. As previously introduced, in all instances the rotation of the second eccentrically weighted rotor assembly 215B can be synchronized with the first eccentrically weighted rotor assembly 215A such that F1 is countered by $F3_x$ while $F2_x$ is countered by $F4_x$. It will be appreciated that the synchronization of the rotation and angular orientations of the eccentric weights M1-M4 to minimize forces transverse to the drive shaft axis 230 can be applicable at any angular separations or other conditions for the first and second eccentrically weighted assemblies 215A, 215B. Accordingly, for ease of reference the first angular separation 310 within the first eccentrically weighted assembly 215A will be discussed below, though it will be appreciated that the second eccentrically weighted assembly 215B can have a similar angular separation established therein and can be synchronized as described above.

As shown in FIGS. 3A-3B, if the first angular separation 310 is greater than 90 degrees a portion of $F1_y$ is countered by $F2_y$ and portion of $F3_y$ is countered by $F4_y$. For angular separations less than 90 degrees, some portion of the centrifugal force F1 will act in concert with the centrifugal force F2.

Figure 3C:
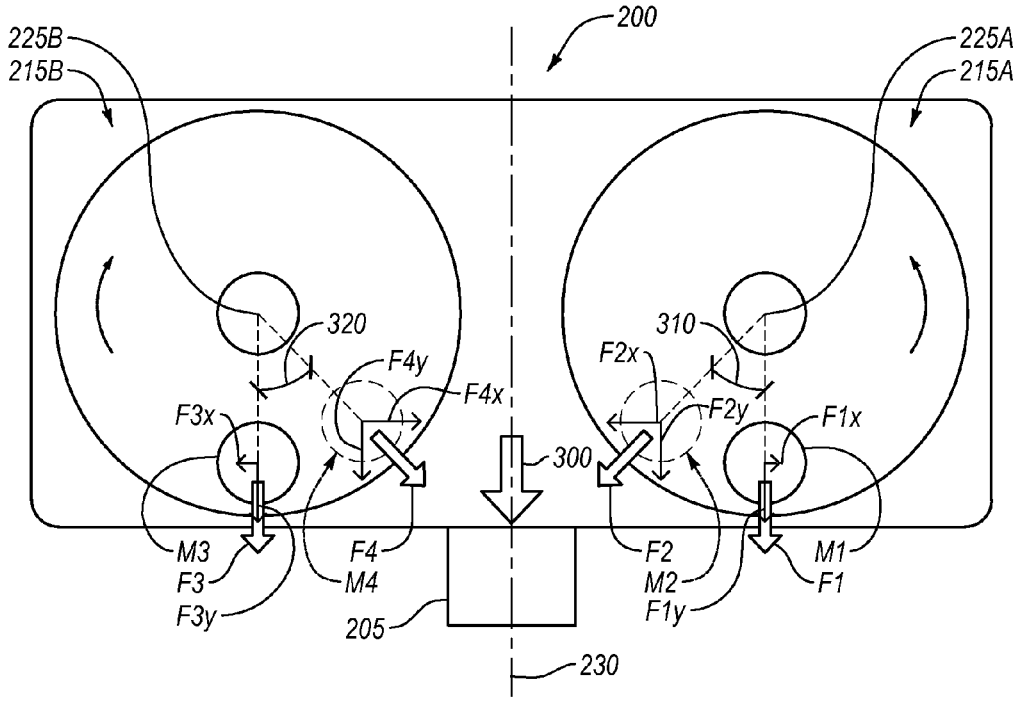

FIG. 3C illustrates a situation in which the first angular separation 310 between the first eccentric weight M1 and the second eccentric weight M2 is less than 90 degrees. As a result, $F2_y$ cooperates with $F1_y$. Similarly, $F4_y$ cooperates with $F3_y$. Accordingly, reducing the first angular separation 310 increases the oscillation forces generated by rotation of the first eccentrically weighted rotor assembly 215A.

Figure 3D:
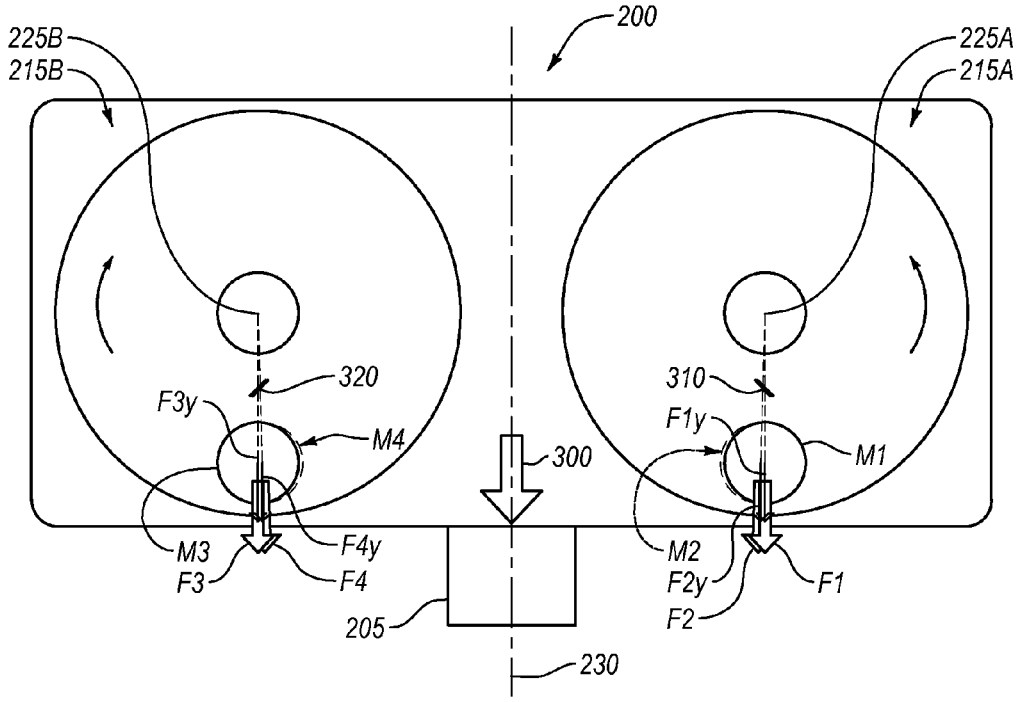

As shown in FIG. 3D, the oscillation forces can reach a maximum when the two eccentric weights M1, M2 are aligned, such that the angular separation 310) is approximately zero. Accordingly, the force generated by the sonic head 200 at a given speed can be varied and tuned by varying the angular separation between two eccentric weights on eccentrically weighted rotors. The angular separation in turn can be varied by translating the coupling shaft 260 relative to the second eccentrically weighted rotor 255, as shown in FIGS. 2B and 2E. Any suitable control device can be used to control movement of the coupling shaft.

Referring now to FIGS. 3A-3D, the rotational speed of the first and second eccentrically weighted assemblies 215A, 215B can also be controlled to vary the oscillation forces generated. In general, an increase in rotational speed generates a proportional increase in the frequency of the oscillation forces as well as an increase in the magnitude of those forces. However, as the frequency of the oscillating forces approaches a natural harmonic of the drilling system 100 (FIG. 1), disproportionately large forces can be generated which can cause the sonic drill head 200 to fail. By controlling the rotational speed as well as the angular separation, a drilling system can generate a wide range of oscillation forces while avoiding undesired effects of natural harmonics in a drilling system. In at least one example, a control device may be rigidly attached to the splined shaft 260 while in other examples a control device may not be rigidly attached to the splined shaft 260. Further, a coupling may be provided between a control device and the splined shaft 260 as desired, such as to isolate a control device from vibrational energy.

In at least one example, the first and second oscillator assemblies 215A, 215B can be rotated with desired first and second angular separations 310, 320, such as 180 degrees of angular separation. The rotational speeds of the first and second eccentrically weighted assemblies 215A, 215B can then be increased above that corresponding to a natural harmonic frequency. Thereafter, the angular separations 310, 320 can be decreased as desired to generate increased oscillation forces. Accordingly, the angular separations 310, 320 as well as the rotational speeds can be varied to allow for higher frequency and/or higher oscillation forces while avoiding potentially destructive natural harmonic frequencies. As previously introduced, the angular separations 310, 320 can be varied in any suitable manner.

Figure 4:
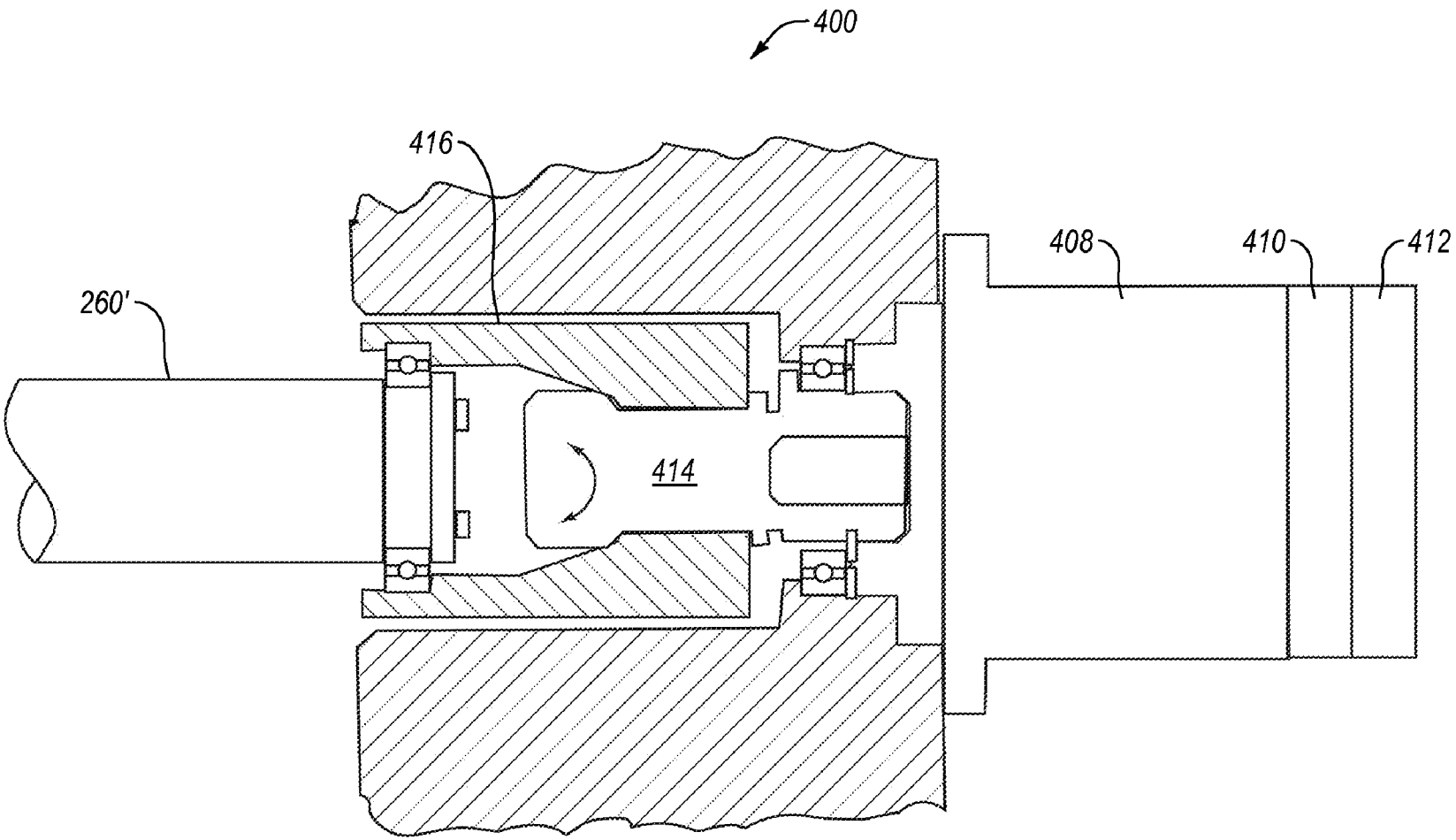
FIG. 4 illustrates an actuation assembly according to one example.

One exemplary control device 400 is shown and described in more detail with reference to FIG. 4. The control device 400 can be configured to position the coupling shaft 260'. In at least one example, the control device 400 includes a stepper motor 408, an encoder 410 and brake 412. A gearbox (not shown) may also be utilized as appropriate or desired. The output shaft of the stepper motor is coupled to a coupling shaft 260' via a ball screw 414 and nut 416. Further, any device can be used that is capable of converting rotational motion into translating motion.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A sonic drill head, comprising:

a housing;

an oscillator assembly positioned within the housing, the oscillator assembly comprising:

a first eccentrically weighted rotor having a first eccentric weight configured to rotate about an axis;

a second eccentrically weighted rotor having a second eccentric weight configured to rotate about the axis, the second eccentric weight being spaced a fixed distance from the first eccentric weight along the axis;

a coupling shaft extending along the axis, the coupling shaft coupling the first eccentrically weighted rotor to the second eccentrically weighted rotor such that rotation of the first eccentrically weighted rotor effects a corresponding rotation of the second eccentrically weighted rotor, the coupling shaft having a straight-splined portion configured for direct engagement with the first eccentrically weighted rotor and a helically-splined portion configured for direct engagement with the second eccentrically weighted rotor, and an actuator operatively associated with the coupling shaft such that movement of the actuator along the axis effects a corresponding axial movement of the coupling shaft along the axis;

wherein movement of the coupling shaft along the axis varies the angular separation between the first eccentric weight and the second eccentric weight relative to the axis, and wherein rotation of the first and second eccentric weights about the axis transmits a vibratory force to the housing of the sonic drill head.

2. The sonic drill head of claim 1, wherein movement of the coupling shaft along the axis away from the first eccentrically weighted rotor increases the angular separation between the first eccentric weight and the second eccentric weight relative to the axis.

3. The sonic drill head of claim 2, further comprising a biasing member positioned between the coupling shaft and the first eccentrically weighted rotor, wherein the biasing member is coupled to the coupling shaft such that the coupling shaft is biased for movement toward the second eccentrically weighted rotor along the axis.

4. The sonic drill head of claim 3, wherein the actuator is configured to extend to move the coupling shaft along the axis toward the first eccentrically weighted rotor.

5. The sonic drill head of claim 1, wherein the first eccentrically weighted rotor is configured to have a rotation shaft coupled thereto.

6. The sonic drill head of claim 1, wherein the actuator is configured to vary the angular separation between the first eccentric weight and the second eccentric weight between 0 degrees and 180 degrees relative to the axis.

7. The sonic drill head of claim 1, wherein the actuator is a hydraulic cylinder.

8. The sonic drill head of claim 7, wherein the hydraulic cylinder comprises an integrated linear variable differential transformer (LVDT) transducer.

9. A method of applying vibration to a drill string, the drill string extending along a drive shaft axis, the method comprising:

operatively coupling a sonic drill head to the drill string, the sonic drill head comprising:

a housing; and a first oscillator assembly positioned within the housing, the oscillator assembly comprising:

a first eccentrically weighted rotor having a first eccentric weight configured to rotate about a first axis in a first direction;

a second eccentrically weighted rotor having a second eccentric weight configured to rotate about the first axis in the first direction, the second eccentrically weighted rotor being spaced at a fixed distance from the first eccentrically weighted rotor along the first axis;

a first coupling shaft extending along the first axis, the first coupling shaft counting the first eccentrically weighted rotor to the second eccentrically weighted rotor such that rotation of the first eccentrically weighted rotor effects a corresponding rotation of the second eccentrically weighted rotor, the first coupling shaft having a straight-splined portion configured for direct engagement with the first eccentrically weighted rotor and a helically-splined portion configured for direct engagement with the second eccentrically weighted rotor, and a first actuator operatively associated with the first coupling shaft such that movement of the actuator along the first axis effects a corresponding axial movement of the first coupling shaft along the first axis;

selectively moving the first coupling shaft along the first axis to produce a desired angular separation between the first eccentric weight and the second eccentric weight relative to the first axis, and rotating the first and second eccentric weights about the first axis in the first direction to transmit a first vibratory force to the housing of the sonic drill head, the first vibratory force comprising a first component acting in a transmission direction, the transmission direction being substantially parallel to the drive shaft axis.

10. The method of claim 9, wherein the sonic drill head further comprises a second oscillator assembly positioned within the housing, and wherein the method further comprises rotating the second oscillator assembly about a second axis in a second direction, the second direction being opposite the first direction.

11. The method of claim 10, wherein the second oscillator assembly comprises:

a third eccentrically weighted rotor having a third eccentric weight configured to rotate about the second axis in the second direction;

a fourth eccentrically weighted rotor having a fourth eccentric weight configured to rotate about the second axis in the second direction the fourth eccentrically weighted rotor being spaced from the third eccentrically weighted rotor along the second axis at a fixed distance;

a second coupling shaft extending along the second axis, the second coupling shaft coupling the third eccentrically weighted rotor to the fourth eccentrically weighted rotor such that rotation of the third eccentrically weighted rotor effects a corresponding rotation of the fourth eccentrically weighted rotor, and a second actuator operatively associated with the second coupling shaft such that movement of the second actuator along the second axis effects a corresponding axial movement of the second coupling shaft along the second axis, wherein the step of rotating the second oscillator assembly comprises rotating the third and fourth eccentric weights about the second axis in the second direction to transmit a second vibratory force to the housing of the sonic drill head, the second vibratory force comprising a first component acting in a transmission direction, the transmission direction being substantially parallel to the drive shaft axis.

12. The method of claim 11, wherein the second coupling shaft has a straight-splined portion configured for direct engagement with the third eccentrically weighted rotor and a helically-splined portion configured for direct engagement with the fourth eccentrically weighted rotor, wherein the method further comprises selectively moving the second coupling shaft along the second axis to produce a desired angular separation between the third eccentric weight and the fourth eccentric weight relative to the second axis.

13. The method of claim 12, wherein the desired angular separation between the first and second eccentric weights is substantially equal to the desired angular separation between the third and fourth eccentric weights.

14. The method of claim 13, wherein the first vibratory force produced by rotating the first oscillator assembly in the first direction further comprises a transverse component acting transversely to the transmission direction and wherein the second vibratory force produced by rotation of the second oscillator assembly in the second direction further comprises a transverse component acting transversely to the transmission direction, wherein the transverse component of the first vibratory force substantially cancels the transverse component of the second vibratory force.

15. The method of claim 9, further comprising rotating the first oscillator assembly at a rotational speed, the rotational speed being greater than a rotational speed corresponding to a harmonic frequency of the first oscillator assembly for the selected angular separation between the first and second eccentric weights, and decreasing the angular separation between the first and second eccentric weights from the selected angular separation after the first oscillator assembly is rotating at the rotational speed.

16. The method of claim 15, wherein the selected angular separation between the first and second eccentric weights is approximately 180 degrees.

17. A sonic drill head, comprising:

an oscillator having:

a first oscillator assembly comprising:

a first eccentrically weighted rotor having a first eccentric weight configured to rotate in a first direction about a first axis, a second eccentrically weighted rotor having a second eccentric weight configured to rotate about the first axis, a first coupling shaft extending along the first axis, the coupling shaft coupling the first eccentrically weighted rotor to the second eccentrically weighted rotor such that rotation of the first eccentrically weighted rotor effects a corresponding rotation of the second eccentrically weighted rotor, the first coupling shaft having a straight-splined portion configured for direct engagement with the first eccentrically weighted rotor and a helically-splined portion configured for direct engagement with the second eccentrically weighted rotor, and a first actuator operatively associated with the first coupling shaft such that movement of the actuator along the first axis effects a corresponding axial movement of the first coupling shaft along the first axis;

a second oscillator assembly comprising:

a third eccentrically weighted rotor having a third eccentric weight configured to rotate in a second direction about a second axis, the second direction being opposite the first direction, a fourth eccentrically weighted rotor having a fourth eccentric weight configured to rotate about the second axis, a second coupling shaft extending along the first axis the coupling shaft coupling the first eccentrically weighted rotor to the second eccentrically weighted rotor such that rotation of the first eccentrically weighted rotor effects a corresponding rotation of the second eccentrically weighted rotor, the second coupling shaft having a straight-splined portion configured for direct engagement with the third eccentrically weighted rotor and a helically-splined portion configured for direct engagement with the fourth eccentrically, weighted rotor, and a second actuator operatively associated with the second coupling shaft such that movement of the actuator along the second axis effects a corresponding axial movement of the second coupling shaft along the second axis; and a drive shaft operatively associated with the oscillator, wherein movement of the first coupling shaft along the first axis varies the angular separation between the first eccentric weight and the second eccentric weight relative to the first axis, wherein movement of the second coupling shaft along the second axis varies the angular separation between the third eccentric weight and the fourth eccentric weight relative to the second axis, and wherein rotation of the first and second oscillator assemblies transmit a desired oscillation force to the drive shaft.

18. The sonic drill head of claim 17, wherein the first oscillator assembly and the second oscillator assembly are positioned on opposing sides of the drive shaft.

19. The sonic drill head of claim 17, wherein the first eccentric weight is spaced a fixed distance from the second eccentric weight along the first axis.

20. The sonic drill head of claim 19, wherein the third eccentric weight is spaced a fixed distance from the fourth eccentric weight along the second axis.

21. The sonic drill head of claim 17, wherein the first oscillator assembly further comprises a first biasing member positioned between the first coupling shaft and the first eccentrically weighted rotor, the first biasing member being coupled to the first coupling shaft such that the first coupling shaft is biased for movement toward the second eccentrically weighted rotor along the first axis.

22. The sonic drill head of claim 21, wherein the second oscillator assembly further comprises a second biasing member positioned between the second coupling shaft and the second eccentrically weighted rotor, the second biasing member being coupled to the second coupling shaft such that the second coupling shaft is biased for movement toward the second eccentrically weighted rotor along the second axis.

* * * * *